United States Patent [19]

Goniwicha

[11] 4,148,124

[45] Apr. 10, 1979

[54] METHOD AND APPARATUS FOR ATTACHING MEMBERS TOGETHER

[76] Inventor: Dennis R. Goniwicha, 736 Robertson, Brighton, Mich. 48116

[21] Appl. No.: 825,973

[22] Filed: Aug. 19, 1977

[51] Int. Cl.[2] ..... B23P 11/00

[52] U.S. Cl. ..... 29/432; 29/525

[58] Field of Search ..... 29/432, 522, 525

[56] References Cited

U.S. PATENT DOCUMENTS

| | | | |
|---|---|---|---|
| 1,991,140 | 2/1935 | Currier | 29/432 UX |
| 2,133,916 | 10/1938 | Churchill | 29/432 UX |
| 2,713,197 | 7/1955 | Schmidt | 29/432 |
| 3,276,499 | 10/1966 | Reusser | 29/432 X |
| 3,733,696 | 5/1973 | Scofield | 29/525 X |
| 3,947,940 | 4/1976 | Augustine | 29/525 X |

*Primary Examiner*—Leon Gilden

*Attorney, Agent, or Firm*—Gifford, Chandler, Van Ophem, Sheridan & Sprinkle

[57] ABSTRACT

A method and apparatus are provided for attaching a first member having a predetermined cross-sectional shape to a thin walled second member at a predetermined attachment position. The second member is supported on one side around the outer periphery of an area substantially corresponding to the shape of the first member at the attachment position on the second member. A drive means then engages and drives the first member through the other side of the second member at the attachment position whereby the first member punches a plug corresponding to the shape of the first member from the second member. The first member thus forms a hole in the second member in which the first member is frictionally engaged.

10 Claims, 6 Drawing Figures

Fig-4
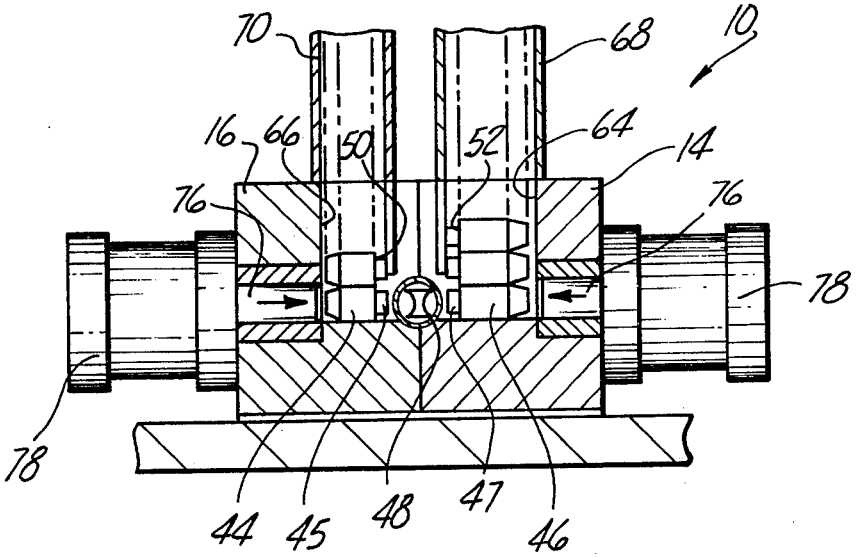
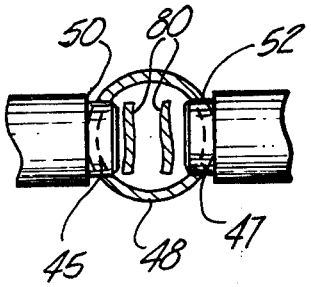
Fig-5
Fig-6
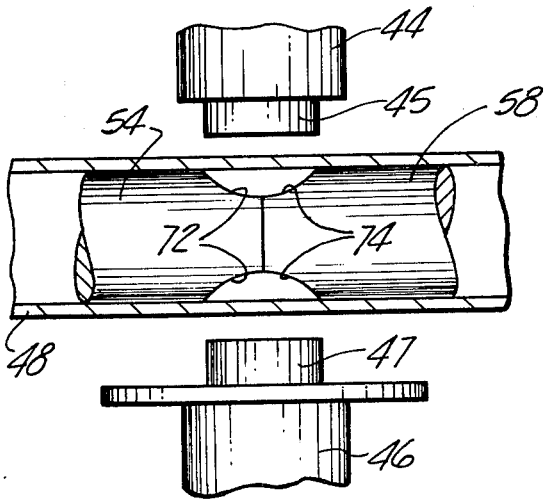

METHOD AND APPARATUS FOR ATTACHING MEMBERS TOGETHER

BACKGROUND OF THE INVENTION

1. Field of the Invention

The present invention relates to a method and apparatus for attaching a first member to a second thin walled member by driving the first member through the second member.

2. Description of the Prior Art

There are many previously known methods and devices for attaching one member to a second thin walled member. Moreover, for ease of description only, it will be assumed that the first member is a fluid connector while the second member is a thin walled tube such as might be found in an air conditioning system for an automobile.

It has been the previous practice in attaching fluid connectors to tubes to first predrill each tube at the intended point of connection with the fluid connector and to then insert the fluid coupling into the drilled hole. Thereafter, each fluid connector is welded or brazed to the tube thus obtaining a fluid tight connection between the tube and each fluid connector.

The previously known method of attaching fluid couplings to tubes, however, is disadvantageous in several different aspects. First, the process of drilling the hole or holes in the tube not only is time consuming but also is a relatively expensive machining process. In addition, the drill must be periodically replaced or sharpened which consumes not only machine and labor costs but also results in down time for the machine.

A still further disadvantage of this previously known method of attaching fluid connectors to a tube is that due to manufacturing tolerances and variations between the various fluid connectors, many fluid connectors are smaller than the hole drilled through the tube. As a result, the fluid connectors are not frictionally attached to the tube but rather are quite loose and tend to fall or separate from the tube. In any event a loose or missing fluid connector cannot be brazed to the tube adequately to obtain a fluid tight connection so that the tube must be scrapped. In practice up to 30% of the tubes must be scrapped which, of course, results in an unnecessarily high cost for the finished assembly of the tube with its attached fluid connectors.

SUMMARY OF THE PRESENT INVENTION

The present invention overcomes the above mentioned disadvantages of the previously known methods and devices by providing both an apparatus and method for frictionally attaching a first member to a thin walled second member, such as a fluid connector and tube, respectively, which virtually eliminates all scrappage for such assemblies.

In brief, the device of the present invention includes means for clamping the second thin walled member and supporting one side of the thin walled member around the outer periphery of an area corresponding to the portion of the first member which is to be attached to the second member. Thereafter, suitable means, such as a piston and cylinder arrangement, are actuated which engages one end of the first member and forces the other end of the first member through the second member at the predetermined location. The first member coacts with the support means so that a plug substantially corresponding to the cross-sectional shape of the first member is punched from the thin walled member as the drive means forces the first member through the second member. Upon retraction of the drive means, the second member is frictionally secured to the thin walled member.

In practice, the precise size of a plug punched from the thin walled member by the first member corresponds to the cross-sectional shape of the first member. Consequently, manufacturing tolerances between the first members are automatically compensated for since the first member acts as its own punch. As such, scrappage is kept to a bare minimum and is virtually zero.

A still further advantage of the device of the present invention is that the attachment of the first member to the thin walled second member is rapid, simple and inexpensive thereby reducing manufacturing costs over the previously known attachment methods.

BRIEF DESCRIPTION OF THE DRAWINGS

A better understanding of the method and apparatus of the present invention will be had upon reference to the following detailed description when read in conjunction with the accompanying drawing wherein like reference characters refer to like parts throughout the several views and in which:

FIG. 4 is a fragmentary sectional view taken substantially along line 4—4 in FIG. 2;

FIG. 5 is a fragmentary sectional view illustrating the operation of the device of the present invention with parts removed and enlarged for clarity; and FIG. 6 is a fragmentary sectional top view illustrating one portion of the device of the present invention and enlarged for clarity.

DETAILED DESCRIPTION OF THE PRESENT INVENTION

By way of example only, the method and apparatus of the present invention will be described as a method and apparatus for attaching a fluid connector to a thin walled tube, such as might be found in an air conditioning system of an automobile. It will be understood, however, that this is by way of example only and that the method and apparatus of the present invention can be used for attaching virtually any member to a thin walled second member. Consequently the scope of the present invention is limited only by the scope of the appended claims.

Figure 1:
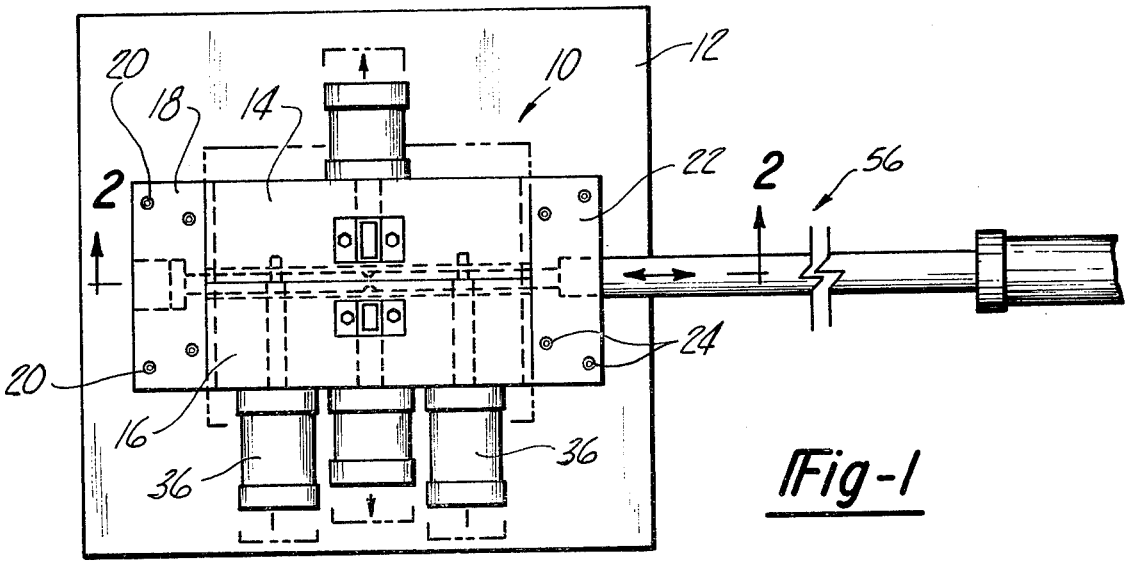
FIG. 1 is a top plan view illustrating the device of the present invention.
Figure 2:
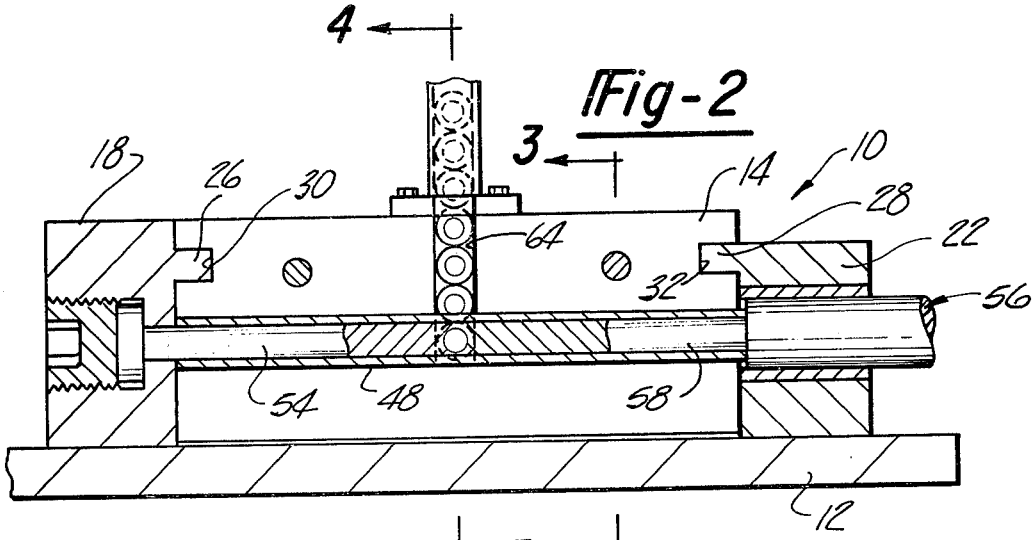
FIG. 2 is a cross-sectional view taken substantially along line 2—2 in FIG. 1 and enlarged for clarity.
Figure 3:
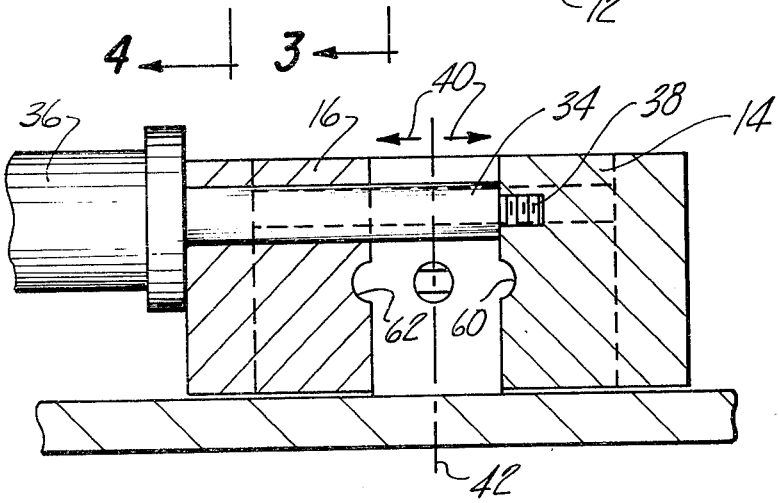
FIG. 3 is a fragmentary sectional view taken substantially along line 3—3 in FIG. 2.

With reference now to FIGS. 1-3, the device 10 of the present invention is thereshown mounted on a worktable 12 and includes a pair of facing jaws 14 and 16 in a side by side relationship. A first side support 18 is secured to the table 12 at one longitudinal end of the jaws 14 and 16 by any appropriate means, such as bolts 20 while a second side support 22 is secured to the table 12 at the other longitudinal end of the jaws 14 and 16 by bolts 24 or the like.

Each side support 18 and 22 includes an inwardly projecting tongue 26 and 28 respectively. The tongue 26 is received within a lateral groove 30 formed along one longitudinal end of the jaws 14 and 16 while, likewise, the tongue 28 is received within a lateral groove 32 formed in the other longitudinal end of the jaws 14 and 16. The tongues 26 and 28 are slidably received within their corresponding grooves 30 and 32 so that the jaws 14 and 16 can move laterally along the table 12 relative to each other.

With reference now particularly to FIGS. 1 and 3, a pair of piston 34 and cylinder 36 arrangements are provided to laterally move the jaws 14 and 16 toward and away from each other along the side supports 18 and 22. The outwardly extending end 38 of each piston 34 is secured to one jaw 14 while the cylinde 36 is secured by means not shown to the other jaw 16. Consequently, extension of the piston 34 from the cylinder 36 simultaneously moves the jaws 14 and 16 laterally apart as indicated by arrows 40 and away from a center line 42 of the device 10. Conversely, retraction of the piston 34 into the cylinder 36 simultaneously moves the jaws toward each other and the center line 42. Appropriate stop means (not shown) are preferably provided to limit the innermost and outermost lateral position of each of the jaws 14 and 16 to insure that the jaws 14 and 16 abut against each other only at the center line 42 of the device 10. In addition, the cylinders 36 are preferably air actuated although other means, such as hydraulic actuation, can also be used. Moreover, means other than the piston 34 and cylinder 36 arrangement can alternatively be used to laterally move the jaws 14 and 16 toward and away from each other while remaining within the scope of the invention.

With reference now to FIGS. 2–4, the device 10 of the present invention is adapted to frictionally secure a pair of diametrically opposed fluid connectors 44 and 46 to a thin walled thin 48. Each fluid connector 44 and 46 includes a portion 45 and 47, respectively, having a predetermined cross-sectional shape. In addition, each of the connectors 44 and 46, includes an enlarged abutment surface 50 and 52, respectively, formed annularly around the fluid connector portions 45 and 47.

A longitudinally extending cylindrical support member or rod 54 is secured in any conventional fashion to the first side support 18 and extends longitudinally toward the other side support 22. A feed means 56 is provided and includes a reduced diameter rod 58 adapted to carry the tube 48. In addition, the rod 58 is extendable and retractable and coaxially mounted to the table 12 with respect to the rod 54. Consequently, extension of the feed means 56 towards the rod 54 positions the tube 48 over the rods 54 and 58 and between the jaws 14 and 16 as best shown in FIGS. 2 and 3.

The jaws 14 and 16 include a facing, semi-circular clamping surfaces 60 and 62, respectively, which correspond to the outer diameter of the tube 48. Thus upon closure of the jaws 14 and 16 together about the centerline 42, the tube 48 is firmly entrapped between the jaw clamping surfaces 60 and 62 and around the rods 54 and 58 (see FIG. 4).

With reference now to FIGS. 2 and 4, the fluid connectors 52 are stacked one upon each other in a vertical bore 64 formed through the jaw 14 while the fluid connectors 50 are similarly stacked in a vertical bore 66 formed through the other jaw 16. In addition, a pair of hollow chutes 68 and 70 are secured to the jaws 14 and 16, respectively, above the bores 64 and 66. Each chute 68 and 70 is adapted to slidably carry a plurality of fluid connectors 52 and 50 for multiple machine operations as will become hereinafter apparent.

The bottom of each bore 64 and 66 in the jaws 14 and 16 is open transversely so that the portions 45 and 47 of the fluid connectors 44 and 46 can abut against the tube 48. In addition, with reference now particularly to FIG. 6, the abutting outwardly extending axial end of each of the rods 54 and 58 includes a transverse recessed portion 72 and 74, respectively, on each side of each rod 54 and 58 and adjacent the lowermost fluid connector 50 and 52. The rods 54 and 58 therefore support the inner periphery of the tube 48 except along the recesses 72 and 74. Moreover, the area of the tube 48 left unsupported by the recesses 72 and 74 correspond substantially to the cross-sectional area of the portions 45 and 47 of the fluid connectors 44 and 46.

With reference now to FIGS. 4 and 5, a piston 76 and cylinder 78 arrangement is provided for each jaw 14 and 16 for driving the fluid connectors 44 and 46 into the tube 48. One cylinder 78 is secured each jaw 16 and 14 so that the direction of the travel of its pistons 76 is coaxial with the lowermost fluid connector 44 or 46 and with the recessed portions 72 and 74 of the rods 54 and 58. Consequently, upon extension of the pistons 76, each piston 76 engages the outer lateral end of its respective fluid connector 44 or 46 and drives the portions 45 and 47 of the connectors 44 and 46 preferably perpendicularly (radially) into and through the thin walled tube 48. The inner periphery of the tube 48 is supported around the outer periphery of an area substantially corresponding to the fluid connector portions 45 and 47. Thus as the fluid connectors 44 and 46 are forced into the tube 48, the portions 45 and 47 punch a slug 80 (FIG. 5) from the tube 48 which substantially corresponds in cross-sectional shape to the portion 45 or 47 so that the fluid connectors 44 and 46 are frictionally secured to the tube 48. The annular abutment surfaces 50 and 52, of the connectors 44 and 46, of course, limit the inward travel of the connectors 44 and 46 into the tube 48.

Although the operation of the device 10 of the present invention should by now be apparent, the operation will be summarized hereinbelow for clarity.

With the jaws 14 and 16 open or spaced from each other, the feed means 56 extends the rod 58 carrying the tube 48 towards the rod 54 so that as the rods 58 and 54 abut against each other, the tube 48 is positioned around the rods 54 and 58 and between the jaws 14 and 16. Thereafter, the jaws are closed by the piston 34 and cylinder 36 arrangements thus firmly gripping the tube 48 between the clamping surfaces 62 and 60 in the jaws 16 and 14.

With the tube 48 tightly clamped between the jaws 14 and 16, the cylinders 78 are actuated which forces the fluid connector portions 45 and 47 against and through the tube 48 so that the connectors 44 and 46 are frictionally secured to the tube 48. The rods 54 and 58, of course, prevent the tube 48 from collapsing or deforming while the recessed portions 72 and 74 permit the slugs 80 to be punched from the tube.

The pistons 76 are then retracted and the jaws 14 and 16 are opened or spaced apart by the piston 34 and cylinder 36 arrangements. This not only permits the tube 48 with the attached fluid connectors 44 and 46 to be removed from between the jaws 14 and 16 but in addition permits the next fluid connector 46 or 44 to move downward in its respective chute 68 and 70 for attachment to a subsequent tube. The feed means 56 is then retracted and the tube 48 is removed from the rod 58 by conventional means, not shown. A subsequent tube 48 is then positioned over the rod 58 and the process is repeated.

It can therefore be seen that the device 10 of the present invention provides a novel means for frictionally attaching two members together which is simple, inexpensive and rapid in operation. Moreover, by supporting the thin walled tube around its inner periphery except at the point of attachment between the tube and fluid connector, deformation and/or collapse of the tube is effectively prevented.

Having thus described my invention many modifications thereto will become apparent to those skilled in the art to which it pertains without deviating from the spirit of the present invention as defined by the scope of the appended claims.

I claim:

1. A machine for attaching a portion of a first member to a thin walled second member, said first member portion having a predetermined cross-sectional shape and adpated to be attached at a predetermined position to said second member, said machine comprising;

means for supporting one side of said second member around the outer periphery of an area corresponding to the predetermined shape of the first member portion at said predetermined position;

means for driving said portion of said first member through the other side of said second member at said predetermined position whereby a plug of substantially said predetermined shape is punched from said second member of said predetermined shape and whereby said portion of said first member is frictionally engaged in said hole in said second member; and means for clamping said second member against movement, wherein said clamping means further comprises a pair of jaws, means for moving said jaws towards and away from each other, and means for positioning said second member between said jaws whereby said jaws clampingly engage said second member when said jaws are moved together.

2. The invention as defined in claim 1 wherein said second member is a tube and wherein said support means comprises a rod adapted to fit within said tube.

3. The invention as defined in claim 1 and including means for sequentially feeding said first members to said drive means.

4. The invention as defined in claim 2 wherein said rod includes a recessed portion at said predetermined position.

5. The invention as defined in claim 2 wherein said drive means comprises a piston of a piston and cylinder arrangement wherein upon extension of the piston from the cylinder, the outwardly extending end of the piston engages and drives said first member against and through said second member.

6. The invention as defined in claim 5 wherein said piston and cylinder arrangement is air actuated.

7. A machine for attaching a portion of a first member to a thin walled second member, said first member portion having a predetermined cross-sectional shape and adapted to be attached at a predetermined position to said second member, said machine comprising:

means for supporting one side of said second member around the outer periphery of an area corresponding to the predetermined shape of the first member portion at said predetermined position;

means for driving said portion off said first member through the other side of said second member at said predetermined position whereby a plug of substantially said predetermined shape is punched from said second member by said first member thereby forming a hole in said second member of said predetermined shape and whereby said portion of said first member is frictionally engaged in said hole in said second member;

means for clamping said second member against movement; and wherein said second member is a tube and wherein said support means comprises a rod adapted to fit within said tube, said rod including a recessed portion at said predetermined position.

8. The invention as defined in claim 7 and including means for sequentially feeding said first members to said drive means.

9. The invention as defined in claim 7 wherein said drive means comprises a piston of a piston and cylinder arrangement wherein upon extension of the piston from the cylinder, the outwardly extending end of the piston engages and drives said first member against and through said second member.

10. The invention as defined in claim 9 wherein said piston and cylinder arrangement is air actuated.

* * * * *

UNITED STATES PATENT AND TRADEMARK OFFICE

CERTIFICATE OF CORRECTION

PATENT NO. : 4,148,124

DATED : April 10, 1979

INVENTOR(S) : Dennis R. Goniwicha

It is certified that error appears in the above-identified patent and that said Letters Patent are hereby corrected as shown below:

Column 3, line 32, delete "thin" after walled and insert --tube-- therefor.

Signed and Sealed this

*Eleventh* Day of *September 1979*

[SEAL]

*Attest:*

LUTRELLE F. PARKER

*Attesting Officer* *Acting Commissioner of Patents and Trademarks*